US011265981B2

(12) United States Patent
Aoki et al.

(10) Patent No.: US 11,265,981 B2
(45) Date of Patent: Mar. 1, 2022

(54) LIGHT EMITTING ELEMENT DRIVING DEVICE

(71) Applicant: Rohm Co., Ltd., Kyoto (JP)

(72) Inventors: Akira Aoki, Kyoto (JP); Ryo Takagi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 7 days.

(21) Appl. No.: 16/992,642

(22) Filed: Aug. 13, 2020

(65) Prior Publication Data

US 2021/0076465 A1 Mar. 11, 2021

(30) Foreign Application Priority Data

Sep. 6, 2019 (JP) ..... JP2019-162764

(51) Int. Cl.
*H05B 45/14* (2020.01)

(52) U.S. Cl.
CPC ..... *H05B 45/14* (2020.01)

(58) Field of Classification Search
CPC ..... H05B 45/10; H05B 45/14; H05B 45/30; H05B 45/37; H05B 47/11
See application file for complete search history.

(56) References Cited

U.S. PATENT DOCUMENTS 7,365,661 B2 * 4/2008 Thomas ..... H02M 3/1584 341/117
9,098,103 B1 * 8/2015 Milanesi ..... H02M 3/156
2004/0124889 A1 * 7/2004 Koharagi ..... H03K 17/145 327/108
2005/0024898 A1 * 2/2005 Yang ..... H02M 3/33507 363/21.12
2010/0164579 A1 * 7/2010 Acatrinei ..... H02M 1/4208 327/172
2011/0025234 A1 2/2011 Ohtake et al.
2012/0243269 A1 * 9/2012 Ren ..... H02M 3/33507 363/21.12
2014/0218657 A1 * 8/2014 Haruta ..... G09G 3/3426 349/61
2015/0189706 A1 * 7/2015 Yang ..... H05B 45/46 315/224

(Continued)

FOREIGN PATENT DOCUMENTS

DE 102011108091 1/2013
DE 102016214014 2/2017
JP 2011-035134 A 2/2011

*Primary Examiner* — Abdullah A Riyami
*Assistant Examiner* — Syed M Kaiser
(74) *Attorney, Agent, or Firm* — Fish & Richardson P.C.

(57) ABSTRACT

A light emitting element driving device includes, for example, a slope voltage generator generating a slope voltage including information on an inductor current passing through a switching output stage, a sense amplifier generating a sense voltage commensurate with the output current fed to a light-emitting element from the switching output stage, a sense amplifier generating a control voltage commensurate with the difference between the sense voltage and a reference voltage, a comparator comparing the slope voltage with the control voltage to generate a comparison signal, a controller controlling the switching output stage in accordance with the comparison signal, and a clamper limiting the control voltage to equal to or lower than a clamp voltage commensurate with the slope voltage.

10 Claims, 8 Drawing Sheets

(56) References Cited

U.S. PATENT DOCUMENTS

| | | | | |
|---|---|---|---|---|
| 2017/0034887 | A1 | 2/2017 | Ichikawa | |
| 2017/0188420 | A1* | 6/2017 | Kido | H05B 47/25 |
| 2018/0168017 | A1 | 6/2018 | Ichikawa | |
| 2019/0261479 | A1* | 8/2019 | Sekido | H05B 45/38 |

* cited by examiner

LIGHT EMITTING ELEMENT DRIVING DEVICE

CROSS-REFERENCE TO RELATED APPLICATIONS

This application is based on the following Japanese Patent Application, the contents of which are hereby incorporated by reference:

(1) Japanese Patent Application published as No. 2019-162764, filed on Sep. 6, 2019

BACKGROUND OF THE INVENTION

1. Field of the Invention

The invention disclosed herein relates to a light emitting element driving device.

2. Description of Related Art

Conventionally, various types of light emitting element driving devices have been proposed which supply a light emitting element with a constant output current.

One example of conventional technology related to what has just been mentioned is seen in Japanese Unexamined Patent Application Publication No. 2011-35134.

However, in conventional light emitting element driving devices, an overshoot in the output current may occur on recovery from an open fault in a light emitting element or on recovery from an undervoltage in the input voltage.

SUMMARY

In view of the above-mentioned problem encountered by the present inventors, an object of the invention disclosed herein is to provide a light emitting element driving device which can suppress an overshoot in the output current.

According to one aspect of what is disclosed herein, a light emitting element driving device includes, for example, a slope voltage generator configured to generate a slope voltage including information on an inductor current passing through a switching output stage, a sense amplifier configured to generate a sense voltage commensurate with the output current fed to a light-emitting element from the switching output stage, a sense amplifier configured to generate a control voltage commensurate with the difference between the sense voltage and a reference voltage, a comparator configured to compare the slope voltage with the control voltage to generate a comparison signal, a controller configured to control the switching output stage in accordance with the comparison signal, and a clamper configured to limit the control voltage to equal to or lower than a clamp voltage commensurate with the slope voltage.

Other features, elements, steps, benefits, and characteristics of the present invention will become clearer with reference to the following description of preferred embodiments thereof in conjunction with the accompanying drawings.

DETAILED DESCRIPTION OF PREFERRED EMBODIMENTS

LED Lamp Module

Figure 1:
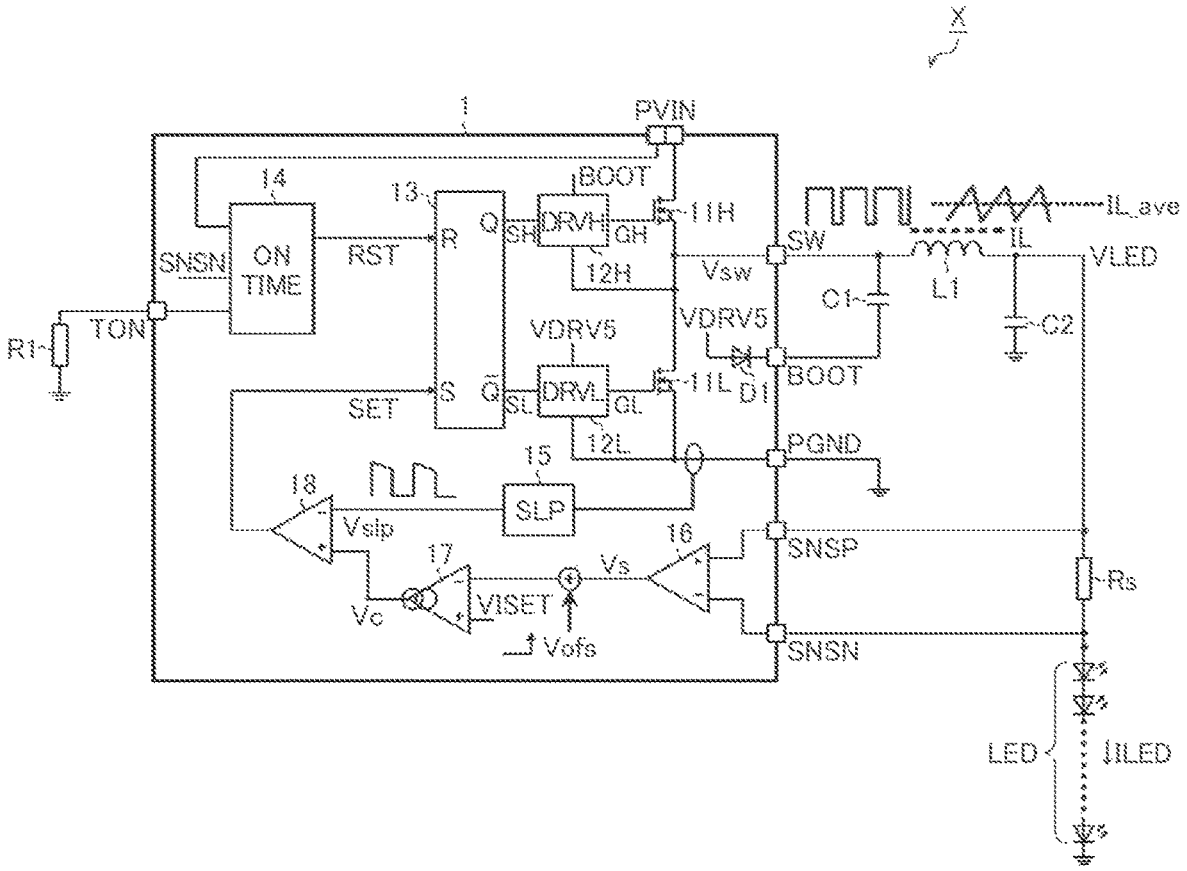
FIG. 1 is a diagram showing an overall configuration of an LED light emitting device.

FIG. 1 is a diagram showing an overall configuration of an LED lamp module. The LED lamp module X of this configuration example includes an LED driver IC 1, a light emitting diode LED 1 (in the diagram, an LED string in which a plurality of light emitting diodes are connected together in series) and various discrete components (capacitors C1 and C2, an inductor L1, a resistor R1, and a sense resistor Rs).

The LED driver IC 1 (corresponding to a light emitting element driving device) is a semiconductor device that bucks (steps down) an input voltage PVIN to supply electric power to the light emitting diode LED. The LED driver IC 1 includes, as a means for establishing electrical connection with outside the IC, a plurality of external terminals (such as a PVIN pin, a TON pin, an SW pin, a BOOT pin, a PGND pin, an SNSP pin, and an SNSN pin).

The PVIN pin is an input voltage supply terminal (power supply terminal) for a power system. The TON pin is a terminal for connection with a resistor for setting an on-time. The SW pin is a switch output terminal. The BOOT pin is a terminal for connection with a bootstrap capacitor for driving a high-side gate. The PGND pin is a ground terminal (power ground terminal) for the power system. The SNSP pin is an output current sense input terminal (+). The SNSP pin is an output current sense input terminal (−).

Between the TON pin and a grounded terminal, the resistor R1 (a resistor for setting an on-time) is connected. The SW pin is connected to the first terminal of the inductor L1. The second terminal of the inductor L1 is connected to the first terminal of the sense resistor Rs. The second terminal of the sense resistor Rs is connected to the anode of the light emitting diode LED. The cathode of the light emitting diode LED is connected to the grounded terminal. Between the SW pin and the BOOT pin, the capacitor C1 (bootstrap capacitor) is connected. Between the anode of the light emitting diode LED and the grounded terminal, the capacitor C2 (output smoothing capacitor) is connected. The PGND pin is connected to the grounded terminal. The SNSP pin is connected to the first terminal of the sense resistor Rs. The SNSN pin is connected to the second terminal of the sense resistor Rs.

LED Driver IC

With reference still to FIG. 1, the circuit configuration of the LED driver IC 1 will be described. The LED driver IC 1 of this configuration example is built by integrating together, as a means for driving the light emitting diode LED, a high-side switch 11H, a low-side switch 11L, a high-side driver 12H, a low-side driver 12L, a controller 13, an on-time setter 14, a slope voltage generator 15, a sense amplifier 16, an error amplifier 17, a comparator 18, and a bootstrap diode D1. Needless to say, the LED driver IC 1 can have any components other than those enumerated above integrated in it (such as various types of protection circuits).

The high-side switch 11H is connected between the PVIN pin and the SW pin, and is turned on and off in accordance with a high-side gate signal GH. Suitably used as the high-side switch 11H is, for example, an NMOSFET (n-channel type metal oxide semiconductor field effect transistor). In this case, the high-side switch 11H is on when GH=H (=BOOT), and is off when GH=L (=SW). It is also possible to use, as the high-side switch 11H, a PMOSFET (p-channel type MOSFET) instead of an NMOSFET. In that case, there is no need for the bootstrap diode D1, the capacitor C1, or the BOOT pin.

The low-side switch 11L is connected between the SW pin and the PGND pin and is turned on and off in accordance with a low-side gate signal GL. Suitably used as the low-side switch 11L is, for example, an NMOSFET. In this case, the low-side switch 11L is on when the GL=H (VDRV5), and is off when the GL=L (PGND).

So connected, the high-side and low-side switch 11H and 11L form a switching output stage of a half-bridge type which outputs a switching voltage Vsw with a rectangular waveform from the SW pin. While the diagram shows an example of a switching output stage employing synchronous rectification, when diode rectification is employed, a diode can be used as the low-side switch 11L.

The high-side driver 12H generates the high-side gate signal GH based on a high-side control signal SH fed from the controller 13. Here, the high level of the high-side gate signal GH equals the terminal voltage at the BOOT pin (≈Vsw+VDRV5). On the other hand, the low level of the high-side gate signal GH equals the terminal voltage at the SW pin (≈Vsw).

The low-side driver 12L generates the low-side gate signal GL based on a low-side control signal SL fed from the controller 13. The high level of the low-side gate signal GL equals a constant voltage VDRV5. On the other hand, the low level of the low-side gate signal GL is the terminal voltage at the PGND pin (that is, the ground voltage).

The controller 13 includes, for example, an RS flip-flop which accepts a set signal SET and a reset signal RST, and generates the high-side and low-side control signals SH and SL so that the high-side and low-side switches 11H and 11L are turned on and off complementarily.

More specifically, the controller 13 generates the high-side and low-side control signals SH and SL so as to turn the high-side switch 11H on and the low-side switch 11L off at a rise in the set signal SET and to turn the high-side switch 11H off and the low-side switch 11L on at a rise in the reset signal RST.

Here, the term "complementarily" in the present description should be understood broadly to cover not only operation where the on/off states of the high-side and low-side switches 11H and 11L are completely reversed, but also operation where a simultaneously-off period (what is called a dead time) for preventing a through current is provided.

The on-time setter 14 raises the reset signal RST to high level when a predetermined on-time Ton has passed after a rise in the set signal SET (that is, after the high-side switch 11H turning on). The on-time setter 14 has a function of setting the on-time Ton as desired according to the resistance value of the resistor R1 connected to the TON pin. The on-time setter 14 also has a function of varying the on-time Ton so as to suppress fluctuation of the switching frequency Fsw based on the respective terminal voltages at the PVIN and SNSN pins.

The slope voltage generator 15 detects the inductor current IL which flows during the on-period of the low-side switch 11L to generate a slope voltage Vslp conveying information on the inductor current IL. The higher the inductor current IL flowing during the on-period of the low-side switch 11L, the higher the slope voltage Vslp, and the lower the inductor current IL, the lower the slope voltage Vslp.

The sense amplifier 16 generates a sense voltage Vs by amplifying the terminal-to-terminal voltage between the SNSP and SNSN pins (the terminal-to-terminal voltage across the sense resistor Rs). The higher the output current ILED (=the average inductor current IL_ave) that passes through the sense resistor Rs, the higher the sense voltage Vs, and the lower the output current ILED, the lower the sense voltage Vs.

Figure 6:
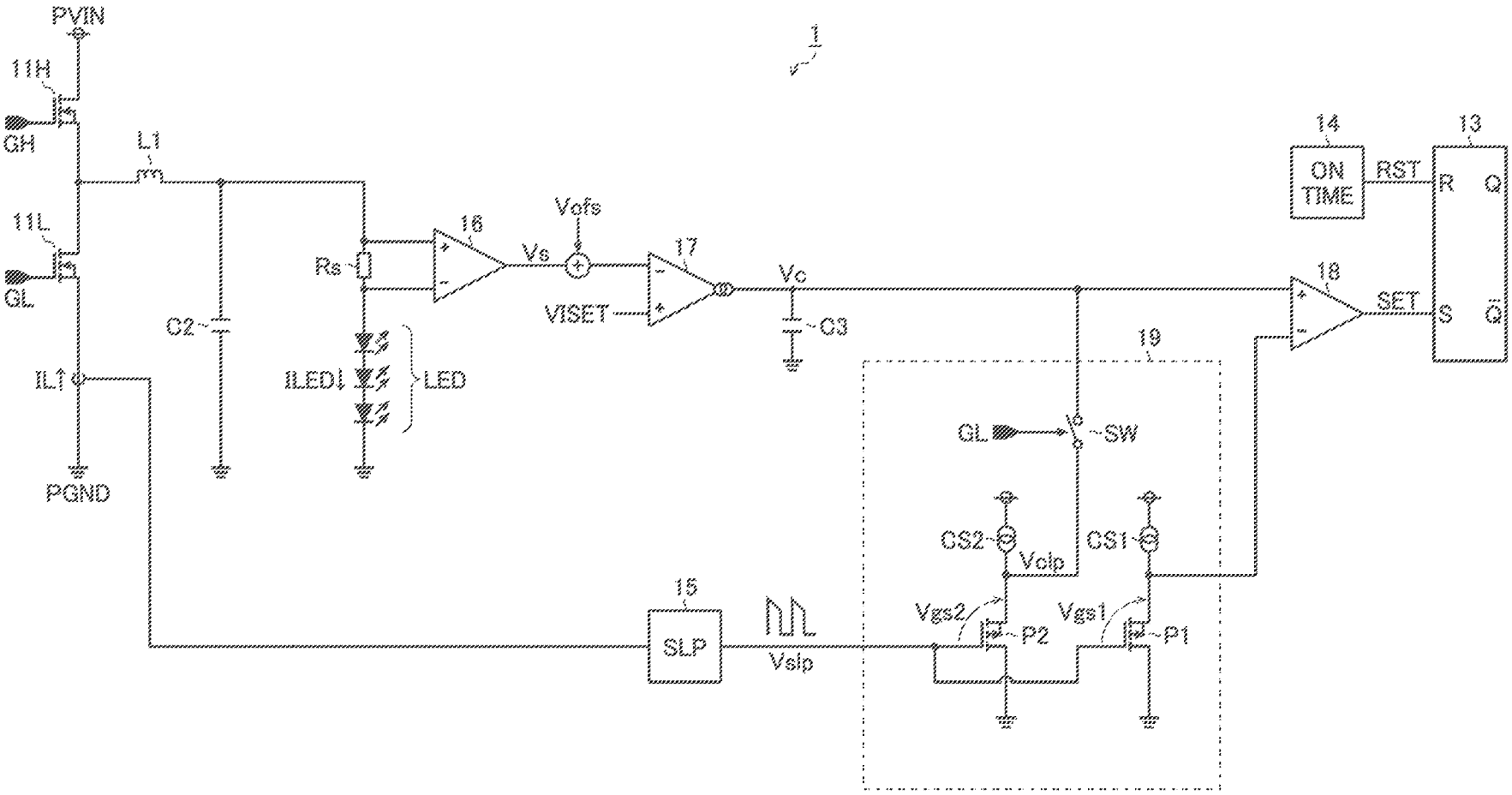
FIG. 6 is a diagram showing a novel embodiment of an LED driver IC.

The error amplifier 17 outputs a current in accordance with the difference between a reference voltage VISET (an analogue light dimmer voltage), which is fed to the non-inverting input terminal (+) of the error amplifier 17, and the sense voltage Vs (more precisely, the sum of an offset voltage Vofs and the sense voltage Vs), which is fed to the inverting input terminal (−) of the error amplifier 17 and generates a control voltage Vc by charging and discharging an unillustrated capacitor (see the capacitor C3 in FIG. 6, which will be referred to later). The control voltage Vc rises when VISET>Vs and falls when VISET<Vs.

The comparator 18 generates the set signal SET by comparing the slope voltage Vslp, which is fed to the inverting input terminal (−) of the comparator 18, with the control voltage Vc, which is fed to the non-inverting input terminal (+) of the comparator 18. The set signal SET is at low level when VC<Vslp and is at high level when Vc>Vslp. Thus, the lower the control voltage Vc, the later the set signal SET rises (that is, the later the high-side switch 11H turns on) and, reversely, the higher the control voltage Vc, the earlier the set signal SET rises.

Of the circuit elements described above, the high-side and low-side drivers 12H and 12L, the controller 13, the on-time setter 14, the slope voltage generator 15, the sense amplifier 16, the error amplifier 17, and the comparator 18 function as an output feedback controller of a bottom detection fixed on-time type, and the high-side and low-side switches 11H and 11L are driven complementarily such that the output current ILED fed to the light emitting diode LED from the switch output terminal SW remains equal to a predetermined target value.

Output Feedback Control

Figure 2:
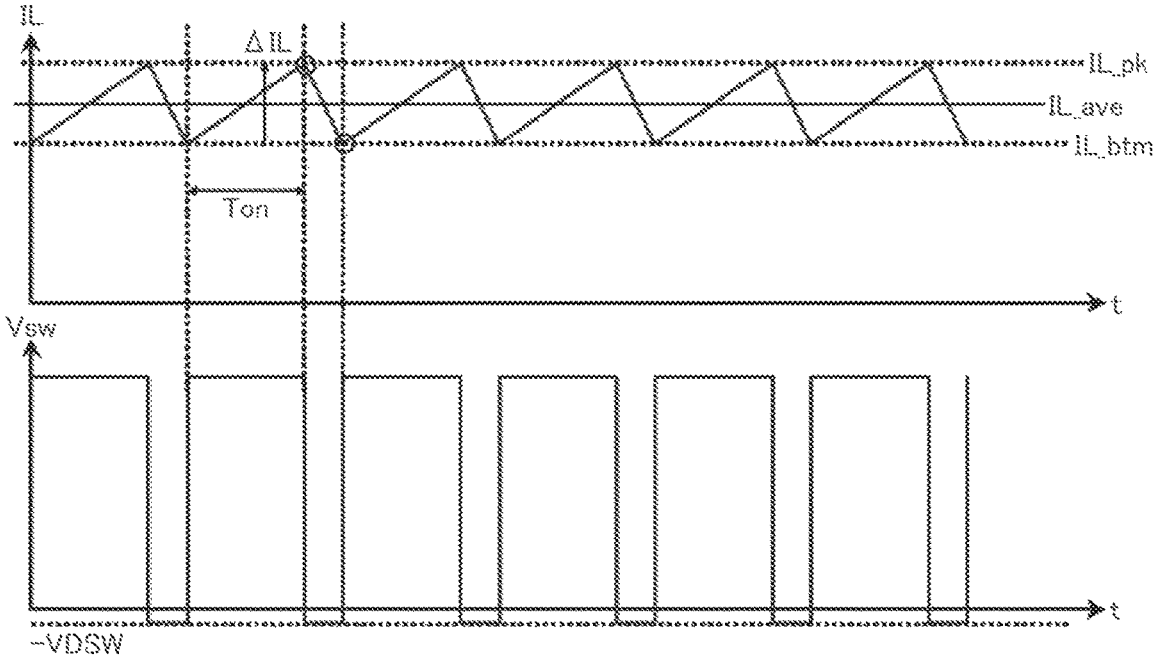
FIG. 2 is a diagram showing output feedback control of a bottom detection fixed on-time type.

FIG. 2 is a diagram showing output feedback control of the bottom detection fixed on-time type, illustrating, from top down, the inductor current IL and the switching voltage Vsw.

When the high-side switch 11H is off and the low-side switch 11L is on, the switching voltage Vsw is at low level (that is, a negative voltage −VDSW that appears between the drain and the source of the low-side switch 11L). Here, the inductor current IL that flows from the PGND pin to the SW pin via the low-side switch 11L decreases as the energy in the inductor L1 is discharged.

Thereafter, when the inductor current IL decreases down to a bottom value IL_btm corresponding to the control voltage Vc, then Vc>Vslp, and the set signal SET rises to high level. As a result, the high-side switch 11H turns on and the low-side switch 11L turns off. Here, the switching voltage Vsw is at high level (≈PVIN), and thus the inductor current IL that flows from the PVIN pin to the SW pin via the high-side switch 11H increases.

Then, when a predetermined on-time Ton has passed, the reset signal RST rises to high level; thus, the high-side switch 11H turns off and the low-side switch 11L turns on, and thus the inductor current IL switches from increasing back to decreasing. As a result, the inductor current IL repeats increasing and decreasing between the peak value IL_pk and the bottom value IL_btm to have a ripple waveform.

Here, the bottom value IL_btm of the inductor current IL varies in accordance with the difference between the sense voltage Vs (corresponding to the average inductor current IL_ave) and the reference voltage VISET (corresponding to the target value for the average inductor current IL_ave). The ripple amplitude ΔIL (=IL_pk−IL_btm) of the inductor current IL is determined in accordance with the on-time Ton.

As a result of the sequence of operation described above being repeated, in the LED driver IC 1, output feedback control of the bottom detection fixed on-time type is performed such that the average inductor current IL_ave (and hence the output current ILED) remains equal to a predetermined target value.

Operation of the bottom detection fixed on-time type is, compared with operation of the PWM control type, advantageous in suppressing subharmonic oscillation. A brief description will be given below with reference to a relevant drawing.

Figure 3:
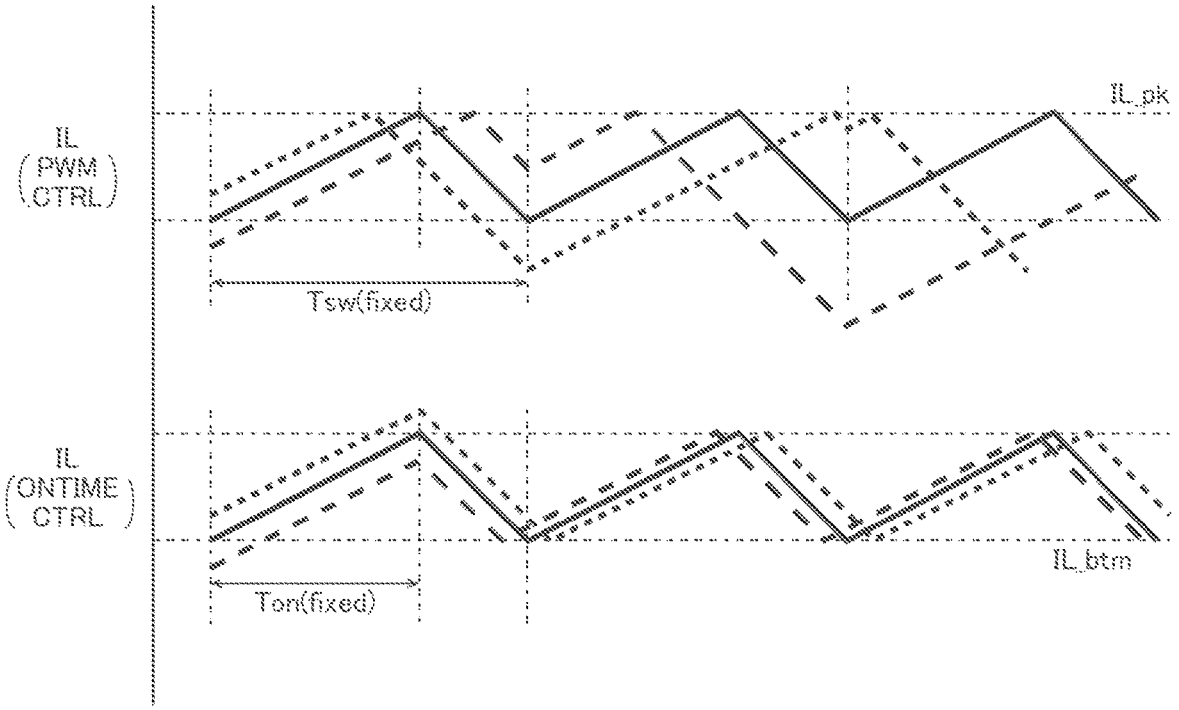
FIG. 3 is a diagram showing how subharmonic oscillation occurs and settles down.

FIG. 3 is a diagram showing how subharmonic oscillation occurs and settles down, illustrating, in the upper row, an inductor current IL in operation of the PWM control type and, in the lower row, an inductor current IL in operation of the bottom detection fixed on-time type.

The solid lines in the diagram show behavior observed when IL=IL_btm at a turn-on time of the high-side switch 11H. On the other hand, the short-stroke broken lines in the diagram show behavior observed when IL>IL_btm at the just-mentioned turn-on time. The long-stroke broken lines in the diagram show behavior observed when IL<IL_btm at the just-mentioned turn-on time.

In general, in operation of the PWM control type where the peak of the inductor current IL is detected (what is called an error amplifier control type), the switching period Tsw is fixed, and thus, without appropriate slope correction, subharmonic oscillation occurs.

On the other hand, in operation of the bottom detection fixed on-time type, even if the inductor current IL changes beyond the peak value IL_pk or the bottom value IL_btm in the current cycle, it necessarily settles down in the following cycle. Thus, there is no need for slope correction for suppressing subharmonic oscillation.

LED Open

Figure 4:
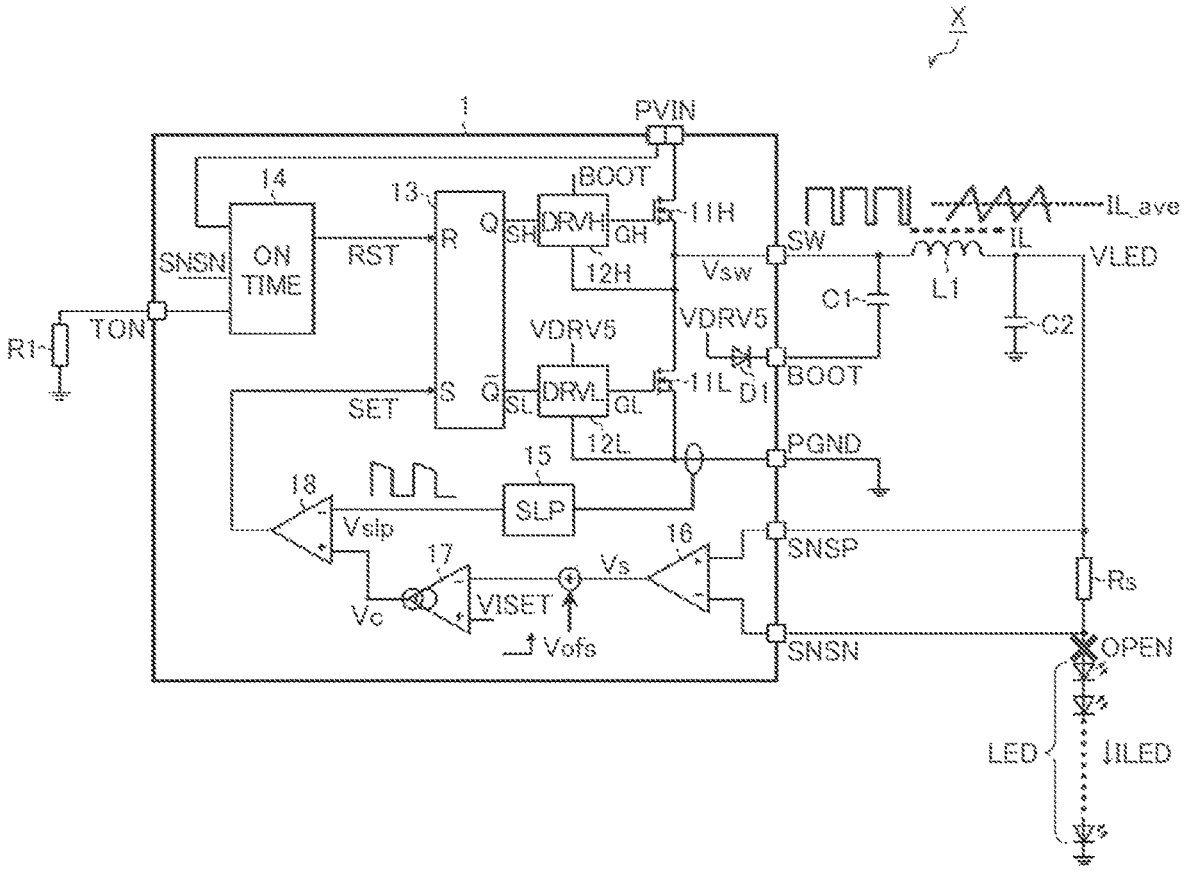
FIG. 4 is a diagram showing a state of an LED open.

Next, behavior observed on occurrence of an LED open (LED open fault) will be studied. FIG. 4 is a diagram showing a state of an LED open. When an LED open occurs (for example, when a line breaks or a connector becomes unplugged between the control circuit board on which the LED driver IC 1 is mounted and the light emitting diode LED), the output current ILED stops flowing through the sense resistor Rs. Thus, in the LED driver IC 1, output feedback operates so as to keep raising the output current ILED. A more detailed description will be given below with reference to FIG. 5.

Figure 5:
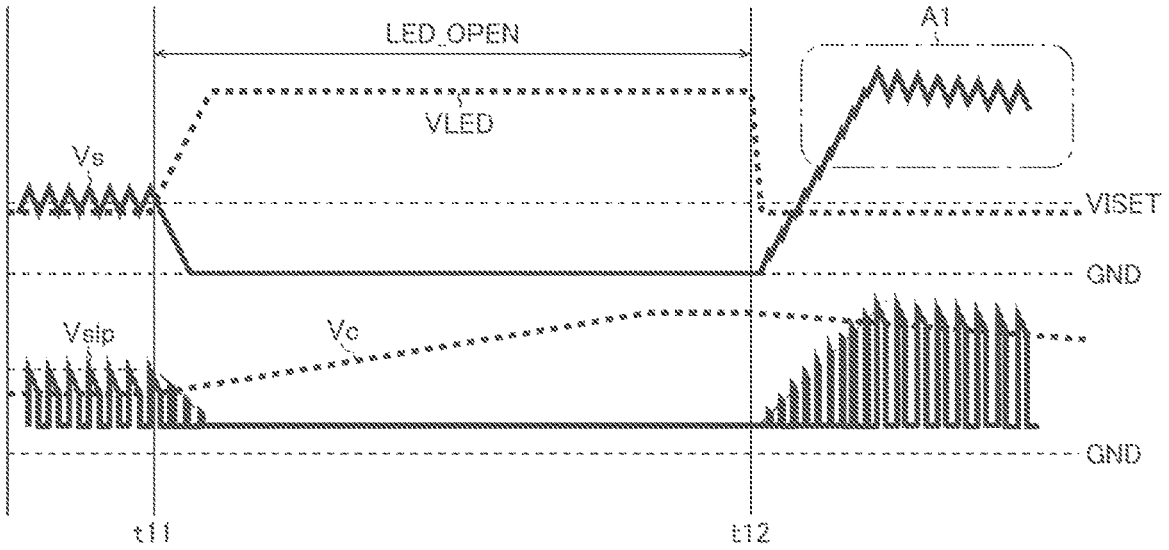
FIG. 5 is a diagram showing how a current overshoot occurs on recovery from an LED open.

FIG. 5 is a diagram showing how a current overshoot occurs on recovery from an LED open. In the upper row of the diagram, the sense voltage Vs (solid line) and the output voltage VLED (broken line) are illustrated. On the other hand, in the lower row of the diagram, the slope voltage Vslp (solid line) and the control voltage Vc (broken line) are illustrated. The relationship between the sense voltage Vs and the reference voltage VISET can be understood as the relationship between the output current ILED and its target value.

At time point t11, when an LED open occurs, the output current ILED stops flowing through the sense resistor Rs, and thus the sense voltage Vs becomes equal to 0 V. Here, the control voltage Vc for controlling the bottom value IL_btm of the output current ILED (and hence the inductor current IL) rises to a potential higher than the control point in steady operation. The slope voltage Vslp, which is compared with the control voltage Vc, falls as the inductor current IL that flows when the low-side switch 11L is on decreases. As a result, in the LED driver IC 1, output feedback control operates so as to keep raising the output current ILED, and thus the on-duty of the switching output stage becomes equal to the maximum value.

Then, at time point t12, on return from the LED open as a result of, for example, plugging of the connector, the supply of the output current ILED is restarted. However, at this point, the control voltage Vc has risen to a potential higher than the control point in steady operation, and thus the on-duty of the switching output stage is kept equal to the maximum value. As a result, as shown in area A1 in the diagram, an overshoot in the output current ILED (a state where the output current ILED has increased beyond the target value) occurs.

Such an overshoot in the output current ILED can occur also on recovery from an undervoltage in the input voltage PVIN (that is, on recovery from an undervoltage state where the input voltage PVIN is lower than the target value of the output voltage VLED to a steady state where the former is higher than the latter).

A description will be given below of a novel embodiment that can appropriately suppress an overshoot in the output current LED on recovery from an open fault in the light emitting diode LED, or on recovery from an undervoltage in the input voltage PVIN.

Embodiment

FIG. 6 is a diagram showing a novel embodiment of the LED driver IC 1. The LED driver IC 1 of this embodiment includes, in addition to the circuit elements described previously (see FIG. 1), a clamper 19.

The clamper 19 includes current sources CS1 and CS2, p-channel type MOS field effect transistors P1 and P2, and a switch SW. During the on-period of the low-side switch 11L, the clamper 19 limits the control voltage Vc to equal to or lower than a clamp voltage Vclp commensurate with the slope voltage Vslp.

The respective first terminals of the current sources CS1 and CS2 are both connected to a power terminal. The second terminal of the current source CS1 and the source of the transistor P1 are both connected to the inverting input terminal (−) of the comparator 18. The second terminal of the current source CS2 and the source of the transistor P2 are both connected to the first terminal of the switch SW. The second terminal of the switch SW is connected to the output terminal of the error amplifier 17 (that is, an application terminal for the control voltage Vc). The control terminal of the switch SW is connected to an application terminal for the low-side gate signal GL (or the low-side control signal SL). The respective drains of the transistors P1 and P2 are both connected to the grounded terminal. The respective gates of the transistors P1 and P2 are both connected to the output terminal of the slope voltage generator 15 (that is, an application terminal for the slope voltage Vslp).

So connected, the current source CS1 and the transistor P1 function as a first voltage follower which generates a voltage (=Vslp+Vgs1) higher than the slope voltage Vslp by the on-threshold voltage Vgs1 (corresponding to a first offset voltage) of the transistor P1 and which outputs the generated voltage to the inverting input terminal (−) of the comparator 18.

Likewise, the current source CS2 and the transistor P2 function as a second voltage follower which generates a clamp voltage Vclp (=Vslp+Vgs2) higher than the slope voltage Vslp by the on-threshold voltage Vgs2 (corresponding to a second offset voltage) of the transistor P2 and that outputs the clamp voltage Vclp to the first terminal of the switch SW.

The device design of the transistors P1 and P2 is such that their respective on-threshold voltages Vgs1 and Vgs2 have the relationship Vgs1<Vgs2 (for example, Vgs2−Vgs1=several tens of millivolts).

The switch SW turns on when GL=H and turns off when GL=L. That is, the switch SW, in synchronism with the switching output stage (in particular, the low-side switch 11L), switches between conducting and cut-off states of the path between the application terminal for the control voltage Vc and the application terminal for the clamp voltage Vclp. Thus, during the on-period (GL=H) of the low-side switch 11L, the control voltage Vc is limited to equal to or lower than the clamp voltage Vclp.

Figure 7:
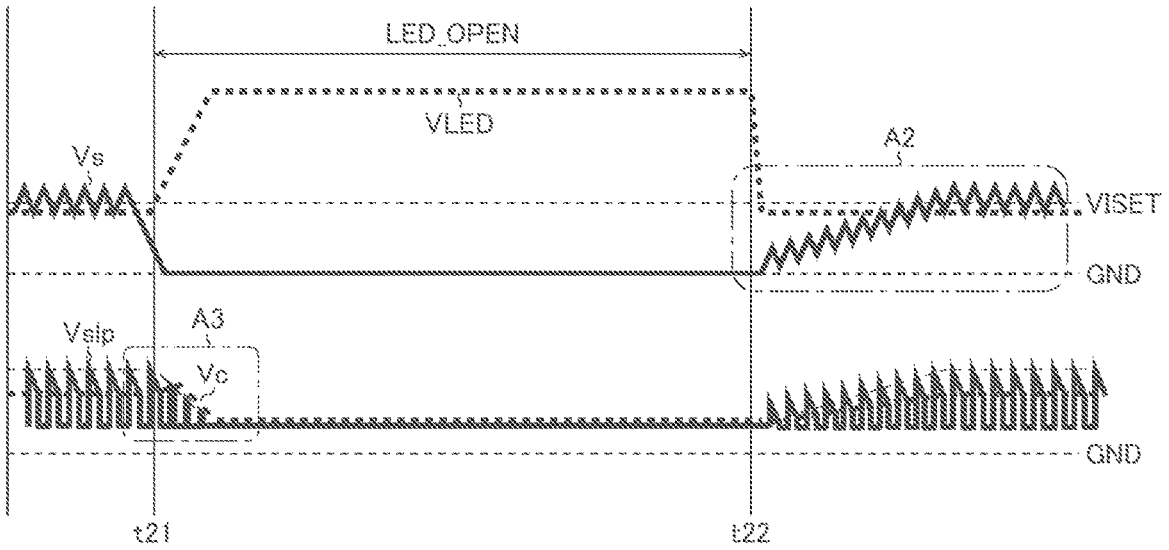
FIG. 7 is a diagram showing how a current overshoot is suppressed on recovery from an LED open.

FIG. 7 is a diagram showing how a current overshoot is suppressed on recovery from an LED open. In the upper row of the diagram, the sense voltage Vs (solid line) and the output voltage VLED (broken line) are illustrated. On the other hand, in the lower row of the diagram, the slope voltage Vslp (solid line) and the control voltage Vc (broken line) are illustrated. The relationship between the sense voltage Vs and the reference voltage VISET can be understood as the relationship between the output current ILED and its target value.

Figure 8:
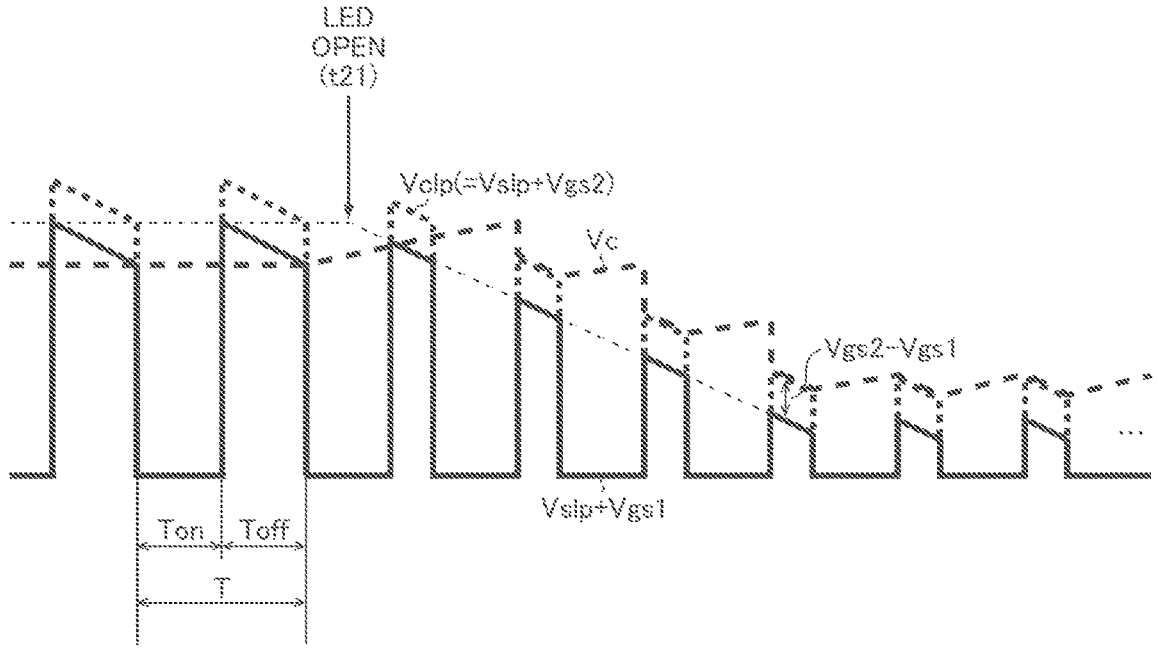
FIG. 8 is an enlarged part view of FIG. 7.

FIG. 8 is an enlarged part view of area A3 in FIG. 7. The solid line indicates the inverting input voltage (=Vslp+Vgs1) of the comparator 18, the short-stroke broken line indicates the clamp voltage Vclp (=Vslp+Vgs2), and the long-stroke broken line indicates the control voltage Vc. The reference sign T in the diagram indicates the cycle of the switching output stage. The reference signs Ton and Toff respectively indicate the on-period (11H: on, 11L: off) and the off-period (11H: off, 11L: on) of the switching output stage.

Before time point t21, no LED open occurs, and thus no drop in the slope voltage Vslp resulting from an LED open occurs. In such steady operation, always Vc≤Vslp+Vgs1 (and hence Vc≤Vclp Vslp+Vgs2)), and thus the control voltage Vc is not clamped.

In particular, by giving an adequate offset (for example, Vgs2−Vgs1=several tens of millivolts) between the respective on-threshold voltages Vgs1 and Vgs2 of the transistors P1 and P2, it is possible to reliably prevent unintended clamping of the control voltage Vc, and this eliminates the risk of impairing the steady operation of the LED driver IC 1.

At time point t21, when an LED open occurs, the output current ILED stops flowing through the sense resistor Rs, and thus the sense voltage Vs becomes equal to 0 V. At this point, the control voltage Vc tends to rise to a potential higher than the control point in steady operation. However, when an LED open occurs, the slope voltage Vslp decreases as the inductor current IL that flows when the low-side switch 11L is on decreases, and thus the clamp voltage Vclp (=Vslp+Vgs2) falls below the control point of the control voltage Vc in steady operation.

As a result, during the on-period of the low-side switch 11L, the control voltage Vc is limited to equal to or lower than the clamp voltage Vclp, and thus, as the slope voltage Vslp lowers, also the control voltage Vc is lowered. By employing such a peak hold technique on the control voltage Vc, in the LED driver IC 1, output feedback control operates so as to keep lowering the output current ILED.

Then, at time point t22, on return from the LED open as a result of, for example, plugging of the connector, the supply of the output current ILED is restarted. At this point, as the slope voltage Vslp rises, the control voltage Vc is gently raised from a potential lower than the control point in steady operation. As a result, as shown in area A2 in the diagram, it is possible to suppress an overshoot in the output current ILED, and thus it is possible to significantly shorten the time required until the output current ILED settles down at the target value.

Although not specifically illustrated, by introducing a clamper 19, it is possible to effectively suppress an overshoot in the output current ILED not only on recovery from an LED open but also on recovery from an undervoltage in the input voltage PVIN.

Overview

To follow is an overview of the various embodiments described herein.

A light emitting element driving device according to what is disclosed herein includes, for example, a slope voltage generator configured to generate a slope voltage including information on an inductor current passing through a switching output stage, a sense amplifier configured to generate a sense voltage commensurate with the output current fed to a light-emitting element from the switching output stage, a sense amplifier configured to generate a control voltage commensurate with the difference between the sense voltage and a reference voltage, a comparator configured to compare the slope voltage with the control voltage to generate a comparison signal, a controller configured to control the switching output stage in accordance with the comparison signal, and a clamper configured to limit the control voltage to equal to or lower than a clamp voltage commensurate with the slope voltage (a first configuration).

In the light emitting element driving device according to the first configuration, the clamper may be configured to include a first voltage follower generating a voltage higher than the slope voltage by a first offset voltage to output the voltage to the comparator, a second voltage follower generating the clamp voltage higher than the slope voltage by a second offset voltage, and a switch switching the path between an application terminal for the control voltage and an application terminal for the clamp voltage between conducting and cut-off states in synchronism with the switching output stage (a second configuration).

In the light emitting element driving device according to the second configuration, it may be configured such that the second offset voltage is higher than the first offset voltage (a third configuration).

In the light emitting element driving device according to the second or third configuration, it may be configured such that the first voltage follower and the second voltage follower respectively include a first transistor and a second transistor of which control terminals are connected to an application terminal for the slope voltage (a fourth configuration).

In the light emitting element driving device according to the fourth configuration, it may be configured such that the on-threshold voltage of the second transistor is higher than the on-threshold voltage of the first transistor (a fifth configuration).

In the light emitting element driving device according to any one of the first to fifth configurations, it may be configured such that the switching output stage is of a half-bridge type including a high-side switch and a low-side switch, and the slope voltage includes information on the inductor current passing when the low-side switch is on (a sixth configuration).

In the light emitting element driving device according to claim 6, it may be configured such that the controller performs output feedback control of a bottom detection fixed on-time type on the output current (a seventh configuration).

In the light emitting element driving device according to claim 7, it may be configured such that the controller turns on the high-side switch and turns off the low-side switch when the inductor current decreases down to a bottom value corresponding to the control voltage, and turns off the high-side switch and turns on the low-side switch when a predetermined on-time passes after the high-side switch turning on (an eighth configuration).

In the light emitting element driving device according to any one of the first to eighth configurations, the reference voltage is an analogue light dimmer voltage which is fed from outside (a ninth configuration).

A light emitting device according to what is disclosed herein is configured to include the light emitting element driving device according to any one of the first to ninth configurations and a light emitting element which is supplied with the output current from the light emitting element driving device (a tenth configuration).

Other Modified Examples

The various technical features disclosed herein may be implemented in any other manner than in the embodiments described above, and allow for many modifications without departing from the spirit of the present invention. That is, the above embodiments should be understood to be in every aspect illustrative and not restrictive. The scope of the present invention is defined not by the description of the embodiments given above but by the appended claims, and should be understood to encompass any modifications made in the sense and scope equivalent to those of the claims.

INDUSTRIAL APPLICABILITY

The invention disclosed herein finds application in, for example, LED driver ICs incorporated in vehicle-mounted LED lamp module.

What is claimed is:

1. A light emitting element driving device comprising:

a slope voltage generator configured to generate a slope voltage including information on an inductor current passing through a switching output stage;

a sense amplifier configured to generate a sense voltage commensurate with an output current fed from the switching output stage to a light emitting element;

an error amplifier configured to generate a control voltage commensurate with a difference between the sense voltage and a reference voltage;

a comparator configured to compare the slope voltage with the control voltage to generate a comparison signal;

a controller configured to control the switching output stage in accordance with the comparison signal; and a clamper configured to limit the control voltage to equal to or lower than a clamp voltage commensurate with the slope voltage.

2. The light emitting element driving device according to claim 1, wherein the clamper includes a first voltage follower configured to generate a voltage higher than the slope voltage by a first offset voltage to output the voltage to the comparator, a second voltage follower configured to generate the clamp voltage higher than the slope voltage by a second offset voltage, and a switch configured to switch a path between an application terminal for the control voltage and an application terminal for the clamp voltage between conducting and cut-off states in synchronism with the switching output stage.

3. The light emitting element driving device according to claim 2, wherein the second offset voltage is higher than the first offset voltage.

4. The light emitting element driving device according to claim 2, wherein the first voltage follower and the second voltage follower respectively include a first transistor and a second transistor of which control terminals are connected to an application terminal for the slope voltage.

5. The light emitting element driving device according to claim 4, wherein an on-threshold voltage of the second transistor is higher than an on-threshold voltage of the first transistor.

6. The light emitting element driving device according to claim 1, wherein the switching output stage is of a half-bridge type including a high-side switch and a low-side switch, and the slope voltage includes information on the inductor current passing when the low-side switch is on.

7. The light emitting element driving device according to claim 6, wherein the controller is configured to perform output feedback control of a bottom detection fixed on-time type on the output current.

8. The light emitting element driving device according to claim 7, wherein the controller is configured to turn on the high-side switch and turn off the low-side switch when the inductor current decreases down to a bottom value corresponding to the control voltage, and to turn off the high-side switch and turn on the low-side switch when a predetermined on-time passes after the high-side switch turning on.

9. The light emitting element driving device according to claim 1, wherein the reference voltage is an analogue light dimmer voltage which is fed from outside.

10. A light emitting device comprising:

the light emitting element driving device according to claim 1; and a light emitting element which is supplied with the output current from the light emitting element driving device.

* * * * *